US008617406B2

(12) United States Patent
Bergaud et al.

(10) Patent No.: US 8,617,406 B2
(45) Date of Patent: Dec. 31, 2013

(54) DEVICE FOR THE ACTIVELY-CONTROLLED AND LOCALIZED DEPOSITION OF AT LEAST ONE BIOLOGICAL SOLUTION

(75) Inventors: Christian Bergaud, Toulouse (FR); Matthieu Guirardel, Toulouse (FR); Pascal Belaubre, Toulouse (FR); Benoit Belier, Orsay (FR); Jean-Bernard Pourciel, St-Orens de Gameville (FR)

(73) Assignee: Centre National de la Recherche Scientifique, Paris (FR)

( * ) Notice: Subject to any disclaimer, the term of this patent is extended or adjusted under 35 U.S.C. 154(b) by 0 days.

(21) Appl. No.: 13/295,441

(22) Filed: Nov. 14, 2011

(65) Prior Publication Data

US 2012/0111129 A1 May 10, 2012

Related U.S. Application Data

(62) Division of application No. 10/514,583, filed as application No. PCT/FR03/01481 on May 15, 2003, now Pat. No. 8,079,832.

(30) Foreign Application Priority Data

May 16, 2002 (FR) ..... 02 06016

(51) Int. Cl.
*C23F 1/00* (2006.01)

(52) U.S. Cl.
USPC ..... 216/2; 216/39; 216/56; 216/72; 216/74; 216/79; 222/146.2; 222/146.5; 222/420; 222/421

(58) Field of Classification Search
None
See application file for complete search history.

(56) References Cited

U.S. PATENT DOCUMENTS

| | | | | |
|---|---|---|---|---|
| 4,115,750 | A | 9/1978 | Hansen et al. | |
| 5,085,562 | A | 2/1992 | Van Lintel | |
| 6,101,946 | A | 8/2000 | Martinsky | |
| 6,179,584 | B1 * | 1/2001 | Howitz et al. | 417/413.2 |
| 6,280,148 | B1 | 8/2001 | Zengeric et al. | |
| 6,530,755 | B2 | 3/2003 | Ingenhoven et al. | |
| 2002/0003177 | A1 | 1/2002 | O'Connor et al. | |

FOREIGN PATENT DOCUMENTS

| | | |
|---|---|---|
| DE | 199 33 838 | 2/2001 |
| WO | WO 00 25923 A | 5/2000 |
| WO | WO 01 03837 A | 1/2001 |
| WO | WO 02 00348 A | 1/2002 |

OTHER PUBLICATIONS

W. Lang, "Silicon Microstructuring Technology", Materials Science and Engineering, R17 (1996) pp. 1-55.*
International Search Report for PCT/FR03/01481, filed May 15, 2003.
Sen, et al.; "A Novel Pump for MEMS Applications"; Journal of Fluids Engineering; vol. 118, 1996.

* cited by examiner

*Primary Examiner* — Lan Vinh
*Assistant Examiner* — Jiong-Ping Lu
(74) *Attorney, Agent, or Firm* — Alston & Bird LLP

(57) ABSTRACT

The invention relates to a device for the actively-controlled deposition of microdrops of biological solutions. The inventive device includes at least one flat silicon lever comprising a central body and an end area which forms a point, a slit or groove being disposed in said point. The invention is characterized in that it also comprises at least one metallic track which is disposed on one face of the central body and which runs alongside said slit or groove at least partially. The invention also relates to a method of producing the inventive device and a method for the active-controlled deposition and sampling of microdrops of biological solutions using said device.

10 Claims, 5 Drawing Sheets

DEVICE FOR THE ACTIVELY-CONTROLLED AND LOCALIZED DEPOSITION OF AT LEAST ONE BIOLOGICAL SOLUTION

CROSS REFERENCE TO RELATED APPLICATIONS

This application is a divisional application of application Ser. No. 10/514,583, filed Nov. 25, 2005, which is a national stage application filed under 35 U.S.C. 371 of International Application No. PCT/FR03/01481, filed May 15, 2003, which claims priority from FR Application No. 02 06016 filed May 16, 2002.

FIELD OF THE INVENTION

The subject of the present invention is a device for the actively controlled, localized deposition of at least one biological solution in the form of microdrops.

BACKGROUND

In the pharmaceutical industry, the capital invested in research for developing new medicines occupies a considerable portion of an enterprise's budget.

New assay methods are needed to reduce the cost of such research.

The arrival of microchips in the biomedical sector has revolutionized the fields of medicinal product development and of bioassay.

The advantages of these microchips are the following:

- they allow new, more sensitive detection methods to be developed;
- they require smaller volumes of reactants, hence a lower cost;
- they allow analytical procedures that are more rapid, owing to their small dimensions; and
- they allow screening or diagnostic studies to be carried out owing to the large number of different solutions present on any one surface.

However, the tools that are currently operational for distributing small volumes of biological material in solution allow the deposition, on glass slides or on membranes, of drops with a diameter of the order of a hundred microns (which corresponds to a drop volume of the order of a nanoliter). These systems rely:

- either, in a first case, on a piezoelectric active device for sucking up and ejecting the products in solution (a contactless deposition system);
- or, in a second case, on a passive mechanism consisting of split pins made of metal (stainless steel, tungsten, etc.), the liquid being sucked up in this second case by capillary effect and being deposited by bringing the end of the pin into contact with a glass slide (a contact deposition system). We should also mention the pin-and-ring system, the operating principle of which is similar to that used with the mechanism consisting of split pins, the ring acting as a liquid reservoir in this case.

Other deposition techniques that have formed the subject of laboratory studies are known, these making it possible to achieve smaller volumes than those obtained with the above-mentioned operational tools.

One of these techniques is dip-pen lithography, which is a technique derived from atomic force microscopy and makes it possible to form features on a surface using a molecular transport diffusion effect at the water meniscus that forms between the tip of an atomic force microscope and the surface on which the deposition takes place. The operating principle relies on the difference in hydrophilicity or wettability properties between the tip and the surface. The surface must in fact be more hydrophilic than the tip in order to cause molecular diffusion from the tip toward the surface. The resolution obtained may be less than 1 micron and it is also possible to envisage the deposition of different biological molecules, but this means changing the tip (which will have been immersed beforehand in the solution to be deposited) for each solution. This deposition technique is therefore extremely time consuming if it is desired to carry out several tens of different depositions. Moreover, changing the tip of the microscope does not make it possible to maintain the alignment precision between two changes. Finally, this approach can be implemented only under high humidity conditions in order for the water meniscus to form.

This technique is described in particular in the following articles:

"Dip-pen Nanolithography" R. D. Piner, J. Zhu, F. Xu, S. Hong and C. A. Mirkin, Science, Vol. 283, pages 661-663, Jan. 29, 1999;

"Multiple Ink Nanolithography: toward a Multiple-Pen Nano-Plotter", S. Hong, J. Zhu and C. A. Mirkin, Science, Vol. 286, pages 523-525, Oct. 15, 1999;

"Surface organization and nanopatterning of collagen by dip-pen nanolithography", D. L. Wilson, R. Martin, S. Hong, M. Cronin-Golomb, C. A. Mirkin and D. L. Kaplan, Proceedings of the National Academy of Sciences of the United States of America, Volume 98, Issue 24, Nov. 20, 2001, pages 13660-13664; and "Dip-Pen nanolithography on semiconductor surfaces", A. Ivanisevic and C. A. Mirkin, Journal of the American Chemical Society, Volume 123, Issue 32, Aug. 15, 2001, pages 7887-7889.

Other microsystems have also been proposed for carrying out depositions for the fabrication of biochips. These apply in general to microfluid structures, for example that described in the following article:

"Micromachined needle arrays for drug delivery or fluid extraction", IEEE Engineering in Medicine and Biology Magazine: the Quarterly Magazine of the Engineering in Medicine & Biology Society, Volume 18, Issue 6, November-December 1999, pages 53-58, J. Brazzle, I. Papautsky and A. B. Frazier.

These are micromachined silicon structures having microfabricated channels, and their use is altogether comparable to that of an ink jet system. These "closed" structures, in the form of tubes, are very difficult to clean, which represents an obstacle to the same device being used to deposit droplets of different liquids.

International patent application WO 02/00348 illustrates a deposition system that allows microdroplets with a volume of between 10 picoliters and 200 nanoliters to be deposited. Such a system consists of at least one lever, made of silica or quartz, equipped with a capillary channel and with a reservoir. The liquid is picked up and deposited purely passively, by capillary effect and by the difference in wettability between the device and the deposition surface.

Micropipettes allowing contactless deposition, by means of a field effect, are described in particular in the following documents:

"Electrospray deposition as a method for a mass fabrication of mono and multicomponent microarrays of biological and biologically active substances", V. N. Morozov and T. Ya. Morozova, Analytical Chemistry, Volume 71, Issue 15, Aug. 1, 1999, pages 3110-3117; and "Atomic force microscopy of structures produced by electrospraying polymer solutions", Victor N. Morozov, Tamara Ya Morozova and Neville R. Kallenbach, International Journal of Mass Spectrometry, Volume 178, Issue 3, Nov. 9, 1998, pages 143-159.

These devices exploit the electrospray effect in order to deposit in a controlled manner, by means of an adjustable electric field, very small amounts of organic molecules. However, the electrospray method consists in applying an electric field high enough to ionize and atomize the liquid to be deposited. The droplets thus produced have submicron dimensions and evaporate before they reach the deposition surface; in this way, thin films are produced. This is therefore a different problem from that facing the present invention, that is to say the deposition of droplets with a volume of the order of 1 picoliter or 1 femtoliter. In addition, the electrospray devices consist of micropipettes containing a needle-shaped electrode; they cannot therefore be effectively washed and have to be replaced each time the liquid is changed.

Studies on surface wetting under the effect of an electric field and the displacement of a liquid by actively controlling the wettability of a surface have been published in the following articles:

"Electrowetting and electrowetting-on-dielectric for microscale liquid handling", J. Lee, H. Moon, J. Fowler, T. Schoellhammer and C. J. Kim, Sensors and Actuators, A 95, pages 259-268, 2002; and "Dielectrophoretic liquid actuation and nanodroplet formation", T. B. Jones, M. Gunji, M. Washizu and M. J. Feldman, Journal of Applied Physics, Vol. 89, No. 2, pages 1441-1448, 2001.

These articles describe the physical principles of electrowetting and dielectrophoresis, and also their application for handling droplets of liquids such as water. Although these effects have been known for several decades, they have never been applied to the deposition of liquid droplets.

In conclusion, no deposition system has yet been proposed that allows microdrops with a diameter of less than 10 microns, that is to say with a volume of less than 1 picoliter (pl), to be deposited in an actively controlled and precise (relative to a reference) manner.

A fortiori, no known deposition system allows such drops to be deposited in a precise and actively controlled manner on microstructures of the bridge, beam or membrane type.

SUMMARY

The present invention makes it possible to achieve these objectives by the use, as deposition system, of one or more silicon microlevers having at least one electrode for handling the liquid to be deposited by electrostatic effects.

One subject of the invention is a deposition device for precise localized and actively controlled deposition of microdrops, in particular with a diameter of less than 10 microns, and more particularly with a diameter of the order of 1 micron.

Another subject of the invention is a deposition device for precise localized and actively controlled deposition of microdrops on microstructures such as bridges, beams or membranes.

Another subject of the invention is a deposition device for depositing different biological molecules.

Another subject of the invention is a deposition device for depositing microdrops without any contact with the structure or the microstructure on which the deposition takes place.

Another subject of the invention is a deposition device for depositing microdrops by contact with a structure or microstructure, under conditions that maintain the integrity of the structure or microstructure.

At least one of the aforementioned objectives is achieved by means of a device for depositing biological solutions, comprising at least one flat silicon lever having a central body and an end region that forms a tip in which a slit or groove is provided, characterized in that it has at least one metal track that is provided on one face of the central body and that runs at least partly alongside a said slit or groove.

Advantageously, said slit or groove extends from said tip as far as a reservoir provided in the central body.

Advantageously, said metal track or tracks run at least partly alongside said reservoir.

According to one embodiment of the device, the reservoir is a non-emergent cavity provided in one main face of the central body.

According to another embodiment, the reservoir consists of an emergent opening provided between two opposed main faces of the central body.

A said slit or groove and/or a said reservoir and/or a said metal track is/are optionally coated with $SiO_2$.

Advantageously, the lever has at least one hydrophobic region made of silicon or else made of silicon oxide coated with a hydrophobic silane.

Advantageously, the device has at least one implanted piezoresistor.

Advantageously, the or each lever has at least one integrated actuator for controlling its bending.

According to a preferred embodiment, said actuator comprises a piezoelectric layer deposited on a surface of said lever.

According to another preferred embodiment, said actuator comprises a bimetallic strip and a heating resistor that is deposited on a surface of said lever.

The invention also relates to a process for fabricating a device as defined above, characterized in that it involves:

- at least one step of depositing silicon oxide on a front face of a silicon-on-insulator substrate having a buried insulating layer;
- the production, for each lever, of at least one metal track;
- at least one chemical or ion etching step carried out via the front face of the silicon substrate in order to define the outline of the levers, and at least one slit or groove, the outline of the levers being defined by chemical or ion etching down to the buried insulating layer; and
- a chemical or ion etching step carried out via the rear face of the substrate in order to remove it, including the buried insulating layer, and to free at least one lever.

The process may be characterized in that b) also includes:

- b1) a second step of depositing oxide on the front face in order to isolate at least one metal track.

The process may be characterized in that c) comprises chemical or ion etching down to the buried insulating layer in order to define, in addition to the outline of the levers, a slit and/or an emergent opening constituting a reservoir for at least one lever.

The process may be characterized in that c) comprises first chemical or ion etching of the substrate, this operation being stopped before the buried insulating layer in order to define at least one groove and/or a non-emergent cavity forming a reservoir, for at least one lever, and second chemical or ion etching of the substrate down to the buried insulating layer in order to define at least the outline of the levers.

The first chemical or ion etching may be carried out in such a way that the outline of the levers is defined over part of their thickness.

Advantageously, before a), a step of implanting at least one piezoresistor is provided.

Advantageously, the process also includes a step of depositing an integrated actuator.

According to a preferred embodiment, said step of depositing an integrated actuator comprises the deposition of a piezoelectric film of $PbZrO_3/PbTiO_3$ by sputtering.

Advantageously, said piezoelectric film is isolated from the liquid by a layer of a material chosen from the following: silicon oxide, "Teflon" PTFE, a polymer.

According to another preferred embodiment, said step of depositing an integrated actuator comprises the low-pressure chemical vapor deposition (LPCVD) of an $Si_3N_4$ layer followed by deposition, by evaporation, of a Cr layer and of an Au layer in order to produce a heating resistor, thus forming a bimetallic strip.

The invention also relates to a method of sampling at least one biological solution using a device as defined above, characterized in that the sampling and the retention of said biological solution are assisted by an electric field effect by applying a potential difference between said metal tracks.

If a device having a piezoresistor is used, advantageously a measurement of the variation in the electrical resistance of said piezoresistor is made after the sampling, in order to determine the amount of biological solution taken.

The invention also relates to a method of depositing at least one biological solution using a device as defined above, characterized in that the deposition of said biological solution is assisted by an electric field effect by applying a potential difference between said metal tracks, which are maintained at the same potential, and a deposition surface having at least one conducting layer.

If a device having a piezoresistor is used, advantageously a measurement of the variation in the electrical resistance of said piezoresistor is made after the deposition, in order to determine the amount of biological solution deposited.

The invention also relates to a method of depositing at least one biological solution using a row of devices as defined above, each having a piezoresistor and an integrated actuator, characterized in that the contact force of each lever with the deposition surface is determined by measuring the variation in the electrical resistance of each implanted piezoresistor that is actively controlled by each integrated actuator.

BRIEF DESCRIPTION OF THE DRAWINGS

Other features and advantages of the invention will become more clearly apparent on reading the following description in conjunction with the appended drawings in which.

DETAILED DESCRIPTION

Figure 1A:
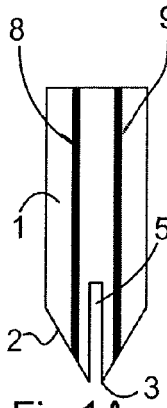
FIGS. 1A and 1B, 2A and 2B, 3A and 3B, and 4A and 4B illustrate lever embodiments according to the invention.

As may be seen in FIGS. 1A-4B, the levers are preferably of rectangular shape (central body 1) terminating in a triangular end 2 forming a tip 3. A groove 4 or slit 5 at the center of the levers, emerging at the tip 3, forms a channel for the liquid. A reservoir 6 or 7 of rectangular shape may be inserted at the upper end of the channel 4 or 5. Two metal tracks 8 and 9 run alongside the channel 4 or 5 and/or the reservoir 6 or 7.

The geometrical dimensions of the levers may be the following:

| | |
|---|---|
| Lever length: | 1 to 2 mm |
| Width: | 100 to 300 μm, for example 210 μm |
| Thickness: | 1 to 20 μm (depending on the thickness of the initial SOI substrate) |
| Inter-lever gap: | 450 μm (for example) |
| Channel length: | 200 to 400 μm, for example 250 μm (when a reservoir is drawn); 200 to 1000 μm, for example 550 μm (with no reservoir) |
| Channel width: | 2 to 20 μm, for example 5 μm |
| Reservoir length: | 200 to 600 μm, for example 250 μm |
| Reservoir width: | 50 to 150 μm, for example 80 μm |
| Width of the conducting tracks: | 1 to 40 μm, for example 20 μm. |

The channel may be a groove 4 provided over part of the thickness of the lever starting from a surface 11, or a through-slit 5 that extends between the faces 11 and 12. The channel may communicate with a non-emergent reservoir consisting of a cavity 6 provided in a main face 11 of the central body 1 of the lever, or else with an emergent reservoir 7 consisting of an opening 7 provided between the main faces 11 and 12 of the central body 1.

Figure 2A:
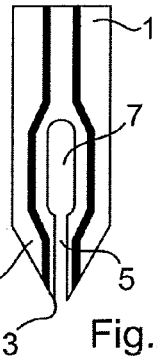
Figure 1B:
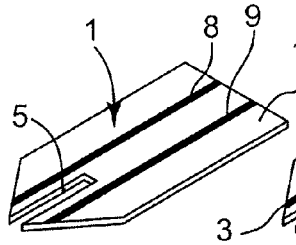
Figure 2B:
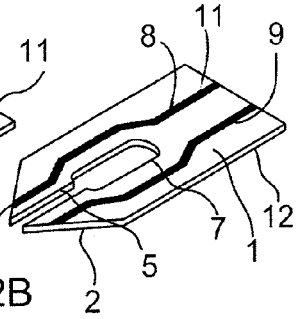
Figure 3A:
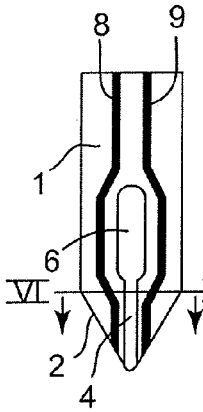
Figure 4A:
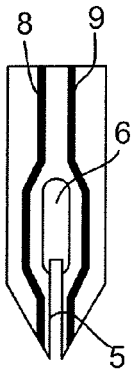
Figure 3B:
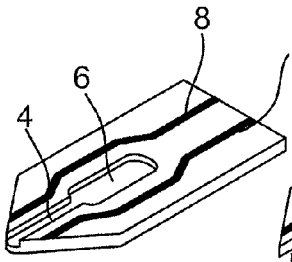
Figure 4B:
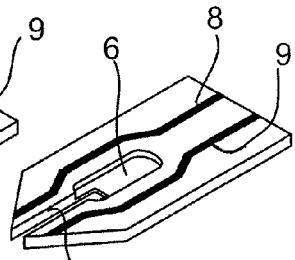

FIGS. 1A and 1B illustrate the case of a slit 5, FIGS. 2A and 2B that of a slit 5 and an emergent reservoir 7, FIGS. 3A and 3B illustrate the case of a groove 4 and a non-emergent reservoir 6 and, finally, FIGS. 4A and 4B illustrate the case of a slit 5 and a non-emergent reservoir 6. The case (not illustrated) of a lever having a groove 4 and an emergent reservoir 6 may also be employed.

The metal tracks 8 and/or 9 run alongside the reservoir 6 or 7 (FIGS. 2A, 2B, 3A, 3B, 4A and 4B) and/or the groove 4 (FIGS. 3A, 3B) and/or the slit 5 (FIGS. 1A, 1B, 2A, 2B, 3A and 3B). As a variant (not shown), a single metal track 8 or 9 may be present.

Figure 6A:
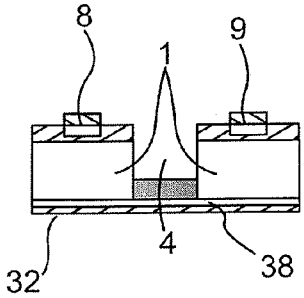
FIGS. 6A and 6B illustrate a sectional view on VI-VI of two other lever embodiments having an integrated actuator.
Figure 6B:
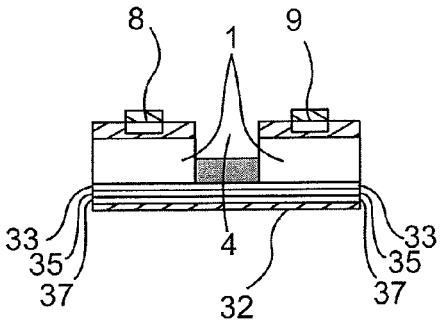

An actuator may be integrated on the rear face of the levers, this consisting of a piezoelectric layer 38 (FIG. 6A) or a bimetallic strip comprising an $Si_3N_4$ layer 33, a chromium layer 35 and a gold layer 37 (FIG. 6B).

Figure 5:
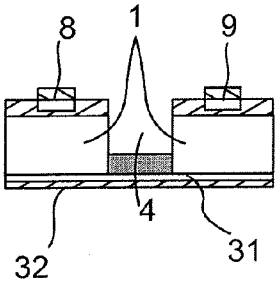
FIG. 5 illustrates a sectional view on VI-VI of a lever embodiment having an integrated piezoresistor.

A piezoresistor 31 may also be integrated on the rear face of the levers (FIG. 5).

Both the piezoresistor 31 and the actuator 33-35-37 or 38 are isolated from the liquid by a passivation layer 32.

The device according to the invention allows in particular:

- a reduction in the volumes deposited: the deposits produced with the present system have, for example, a diameter of the order of 10 microns (picoliter), this characteristic also being parametrizable; it is conceivable to obtain microdrops of the order of 1 μm in diameter (femtoliter), making the device compatible with nanotechnology approaches that are currently used (deposition of drops on nanosensors in particular); and
- the possibility of actively controlling the operation of picking up and depositing the liquid via the metal tracks 8 and/or 9, used as electrodes for exploiting the electrowetting, dielectrophoresis and electrospray effects; and/or
- the possibility of depositing a large variety of organic biological substances (DNA, proteins, cells, etc.) or inorganic substances (polymers, photoresists, etc.); and/or the possible use of very small volumes, and therefore the production of many dots, with a single lever pick-up (more than a hundred or so drops 20 microns in diameter produced in one pick-up); and/or contact or contactless deposition without major modification of the system (for example contactless deposition of DNA, proteins or cells, or contact deposition of DNA or cells); and/or the possibility of integrating a piezoresistor serving as a strain gauge on the microlevers, thereby actively controlling the force and the contact time, and also allowing a row of levers to be aligned with respect to the deposition surface during the contact deposition phase; and/or the possibility, thanks to said active control of the contact force, of depositing substances on microstructures, such as microbeams or micromembranes; and/or measurement of the amount of liquid picked up and deposited by said piezoresistor, operating as a very sensitive balance; and/or the possibility of integrating into the lever an actuator consisting of a piezoelectric layer or a bimetallic strip with a heating resistor; and a greatly reduced cost, thanks to the use of collective fabrication techniques derived from microelectronics; to give an example, a commercial stainless steel pin costs from 300 to 400 dollars, whereas the cost of fabricating a silicon microlever according to the invention leaves one to anticipate a markedly lower overall cost.

Deposition on microstructures, mentioned in item (g), constitutes a major advantage of the invention, since such devices can be used as integrated biomolecule detectors. In this regard, see the articles:

"Translating Biomolecular Recognition into Nanomechanics", J. Fritz, M. K. Baller, H. P. Lang, H. Rothuizen, P. Vettiger, E. Meyer, H.-J. Guentherodt, Ch. Gerber and J. K. Gimzewski, Science, Volume 288, pages 316-318 (2000); and French patent application FR 2 823 998.

Figure 7A:
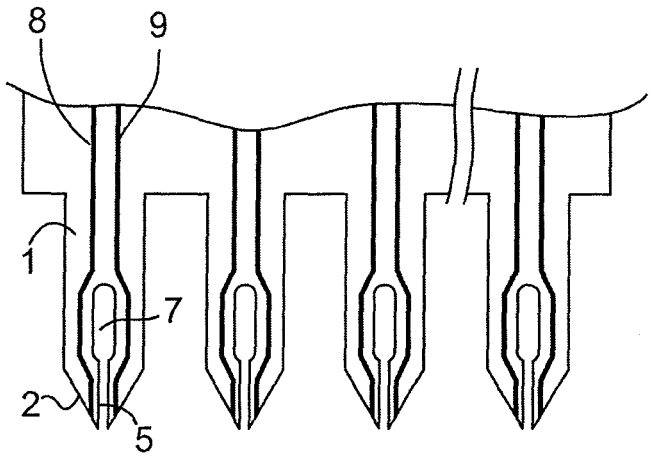
FIGS. 7A and 7B illustrate a device consisting of a set of identical levers forming a row.
Figure 7B:
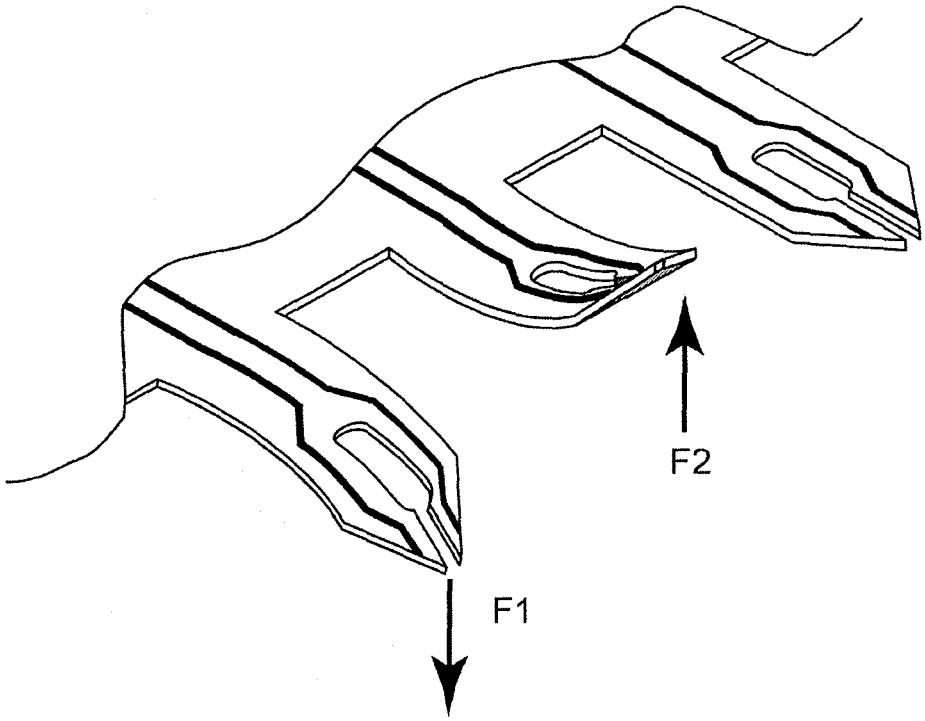

With regard to the actuator mentioned at point (i), this allows only part of the levers constituting a row, as illustrated in FIG. 7A, to be brought into contact with the deposition surface. FIG. 7B shows, for example, a row in which the first lever is bent down toward the deposition surface by the action of said integrated actuator, the second is bent in the opposite direction, away from said surface in order to avoid any contact, and the third is left in its rest position. The arrows F1 and F2 indicate the direction of movement of the tip induced by the integrated actuator in the case of the first and second levers respectively. The actuation of silicon microlevers by piezoelectric films or bimetallic strips is known in the prior art, but it is applied for the first time to a system for depositing microdrops of a liquid. For more details, see the articles:

"Piezoelectric properties of PZT films for microcantilevers", E. Cattan, T. Haccart, G. Vélu, D. Rémiens, C. Bergaud and L. Nicu, Sensors and Actuators 74, pages 60-64 (1999), as regards piezoelectric actuation; and "Micromachined arrayed dip-pen nanolithography probes for sub-100 nm direct chemistry patterning", D. Bullen, X. Wang, J. Zou, S. Hong, S.-W. Chung, K. Ryu, Z. Fan, C. Mirkin and C. Liu, IEEE 16th International Conference on Microelectromechanical Systems, Jan. 19-23, 2003, Kyoto, Japan, pages 4-7, as regards thermomechanical (bimetallic strip) actuation.

The process for fabricating deposition levers is based on the collective fabrication techniques used in microelectronics. A series of technological steps is carried out on an SOI (Silicon On Insulator) substrate.

Figure 8A:
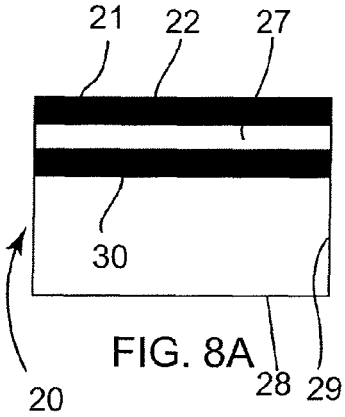
FIGS. 8A to 8J illustrate a process for fabricating levers according to the invention.

The first part of the process comprises a succession of thin-film formation steps (FIGS. 8A and 8C) and the second part consists of a series of micromachining operations so as to define the levers.

The first step (FIG. 8A) is the deposition of silicon oxide 22 by LPCVD (low-pressure chemical vapor deposition) on the front face 21 of a silicon substrate 20 having a buried oxide layer 30. The oxide layer 22 serves as insulator between the substrate and the following metallizations.

Figure 8B:
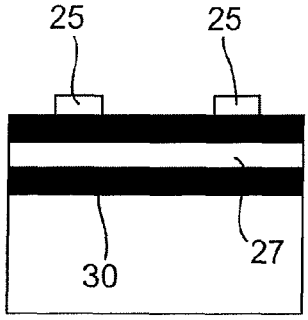
Figure 8C:
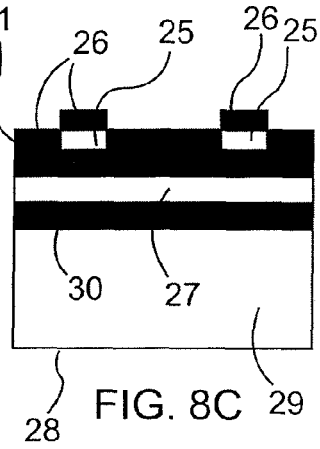

During the step shown in FIG. 8B, the metal tracks 25 are produced by a lift-off technique, namely by photolithography followed by metal deposition 25 by evaporation, and then removal of the resist (used for masking the metallized regions) in acetone and with the application of ultrasound, and finally annealing of the metallization.

The last step of the thin-film part is a second localized deposition 26 of silicon oxide (FIG. 8C) by LPCVD in order to isolate the metallizations from the liquid when the levers are being used, followed by photolithography in order to gain access to the contact pads of the metallizations by etching the silicon oxide.

Figure 8D:
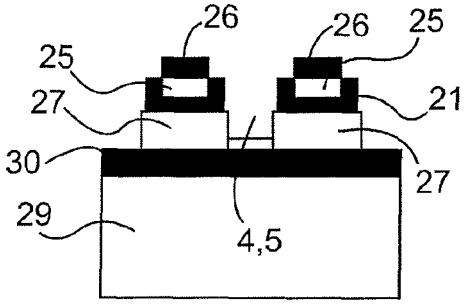

To start the micromachining, front face photolithography in the silicon layer 27 allows the outlines of the levers to be defined. A first plasma etching operation (reactive ion etching or RIE) is then carried out on the silicon oxide, and then a second plasma etching operation is carried out on the single-crystal silicon (FIG. 8D).

Figure 8E:
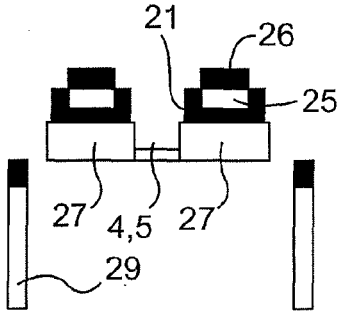

Lastly, a final photolithography operation, starting from the rear face 28 of the wafer, and then a deep reactive ion etching (DRIE) operation on the silicon layer 29 are carried out in order to free the levers (FIG. 8E). The plasma etching is stopped by the silicon oxide stop layer 30 of the SOI. Finally, reactive ion etching of this oxide 30 is carried out—again via the rear face—in order to finish freeing the structures.

When etching the outlines of the levers, several options are possible depending on the desired outline. For levers with an emergent channel (a slit 5 passing through the entire thickness of the lever) with or without a reservoir, a single step (as shown in FIG. 8D) is sufficient, by stopping the silicon etching on the oxide layer of the SOI oxide substrate.

However, to etch non-emergent structures (groove 4 or cavity 6), two photolithographic steps followed by etching have to be carried out in succession. The first, which defines the channel 4 and/or the reservoir 6, must be stopped before the intermediate oxide layer of the SOI substrate is reached. This step must therefore be supplemented with photolithography and etching of just the external outlines of the levers down to the intermediate oxide layer of the SOI substrate.

The optional implantation of at least one piezoresistor, placed for example longitudinally in the body 1 of the lever, may be carried out before the step shown in FIG. 8A. Firstly, a thin oxide is produced before the implantation of the dopants in the silicon. The thickness of this oxide, the dose and the doping energy must be chosen in order to obtain maximum sensitivity of the piezoresistor. Next, the oxide (FIG. 8A) is deposited and then opened by chemical etching at the contacts of the piezoresistor and then metal is deposited (FIG. 8B) by a lift-off step, which takes account of the tracks used as electrodes and the tracks for the piezoresistors. Next, the fabrication process continues as previously.

One or more piezoresistors implanted on at least some of the levers make it possible for there to be one or more strain gauges, the resistance variation of which is used to detect, in particular, when the lever comes into contact with a surface. This makes it possible in particular to ensure control of the coplanarity of the levers during collective deposition.

Optionally, a piezoelectric film 30, for example consisting of a mixture of $PbZrO_3$ and $PbTiO_3$ in a 54/46 ratio may be deposited by sputtering, as described in:

PZT Polarization effects on off-centered PZT patch actuating silicon membranes", M. Guirardel, C. Bergaud, E. Cattan, D. Remiens, B. Belier, S. Petitgrand and A. Bosseboeuf, 16th European Conference on Solid State Transducers (EUROSENSORS XVI), Prague (Czech Republic), Sep. 15-18, 2002, pages 697-700.

Figure 8F:
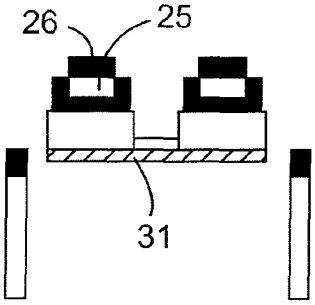
Figure 8G:
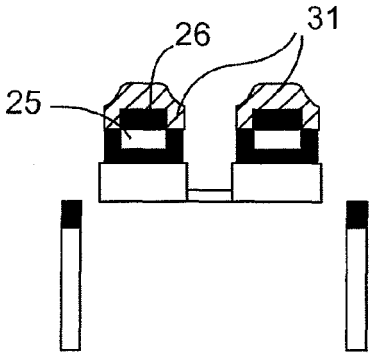

The deposition may be carried out, for example, on the rear face of the lever, as illustrated by FIG. 8F. Alternatively, it may be carried out on the oxide layer 26 that covers the metal tracks 25, as illustrated in FIG. 8G. In both cases, the piezoelectric actuator must be isolated from the liquid by an oxide layer 32 or a layer of any material that ensures effective isolation, namely "Teflon" PTFE, polymer (PDMS, resist, etc.). In this regard see the following articles:

"Tapping mode atomic force microscopy in liquid with an insulated piezoelectric microactuator" B. Rogers, D. York, N. Wishman, M. Jones, K. Murray, D. Adams, T. Sulchek and S. C. Minne, Review of Scientific Instruments 73, pages 3242-3244 (2002); and "High-speed atomic force microscopy in liquid", T. Sulchek, R. Hsieh, S. C. Minne, C. F. Quate and D. M. Adderton, Review of Scientific Instruments 71, pages 2097-2099 (2000).

Figure 8H:
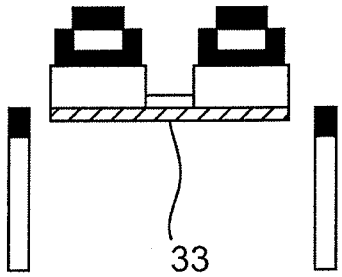
Figure 8I:
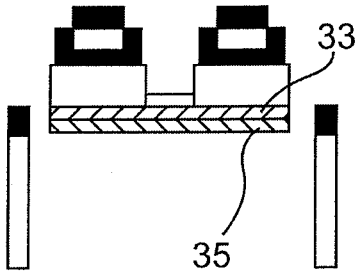
Figure 8J:
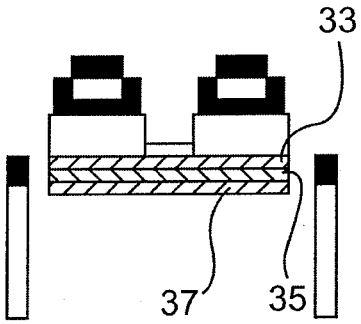

Alternatively, the actuator may consist of a bimetallic strip. FIGS. 8H-8L show the various steps in producing such a device. Firstly, an $Si_3N_4$ layer 33 is deposited by low-pressure chemical vapor deposition (LPCVD) (FIG. 8H). Next, a chromium layer 35 (FIG. 8I) and a gold layer 37 for constituting the heating resistor (FIG. 8L), thus forming a bimetallic strip, are deposited by thermal evaporation. A doped polycrystalline silicon layer may also be used as a heating resistor. Following a lithography step, in order to define the outlines of these elements, is the deposition of an insulating oxide layer and production of the electrical contacts of the heating resistor.

The metal tracks constitute the core of the invention, as they make it possible to control the rise of the liquid into the slit or groove, when filling the device, and its descent during deposition, by field effect.

A first technique, called dielectrophoresis and proposed by Jones et al. (see the document mentioned above), consists in using an AC electric field to confine a polarizable liquid (for example water) in areas of high electric field (the use of a DC field is possible, but it may cause undesirable effects, such as electrolysis of the liquid or it may damage biomolecules). Since this field is created between two coplanar insulated electrodes, the liquid is literally "pressed" against the electrodes. A very similar effect, the physical origin of which is different, occurs in the case of conducting liquids. Moreover, it is important to consider that a liquid may be "conducting" or "dielectric" depending on the frequency of the electric field that is applied thereto. If, within a given frequency range, the liquid constitutes a dielectric, the electrodes need not be coated with an insulator. Another technique, known as electrowetting, allows the wettability properties of a surface (contact angle between the surface and the liquid) to be modified by applying a potential difference between said surface and the liquid, and thus the capillary effects may be controlled. If a potential difference of a few volts to 10 V is applied between the electrodes and a conducting surface, the field effect may cause contactless deposition. A higher potential difference (above 1 kV) may result in electrospraying.

Several surface treatments may be carried out on the levers in order to make them hydrophilic or hydrophobic, so as to optimize the behavior of the liquid deposited on the surface.

Firstly, it is possible to vary the materials derived from silicon, knowing their properties: silicon oxide is thus used as hydrophilic compound, and single-crystal silicon is used as hydrophobic material.

However, since silicon has a natural tendency to undergo surface oxidation (presence of a nascent oxide), it may be necessary to carry out a chemical surface treatment. Such a treatment consists for example in attaching a hydrophobic silane, for example a silane having a methyl or fluorine-containing group as end group, which silane is deposited on the silicon oxide. This compound is deposited on silicon oxide in the form of self-assembled monolayers and has the advantage of being highly hydrophobic.

Alternatively, it is conceivable to use techniques in which remanent charges are created in the oxide, by implantation or irradiation (for example using X-rays), in order to enhance the wettability or hydrophilicity properties of the passivation layer (for example, a cold oxide layer).

In a preferred embodiment of the present invention, the surface of the device is made highly hydrophobic and liquid is picked up by means of the abovementioned dielectrophoresis and electrowetting effects. This makes it easier to clean the device and makes it possible to deposit several different liquids without contamination.

A three-axis (X, Y, Z) microrobot allows the microlevers according to the invention to be used for the filling and deposition phases.

The pick-up phase entails dipping the microstructures into a reservoir containing the solution to be deposited and filling the microchannels by field effect, optionally assisted by capillary effect.

For the deposition phase, the microrobot is used to position the microstructures very precisely with respect to a surface intended to receive the deposit. Deposition then takes place by direct contact with the surface or by contactless field effect. The spray deposition technique can also be considered if the field applied is high enough to cause spray generation and atomization of the biomolecules.

The robot is, for example, a commercially available three-axis (X, Y, Z) robot with a 50 nanometer step, readily compatible with diameters of around 10 to 20 microns of the deposits to be produced. This precision allows fine control of the lever/deposition surface contact, thus giving better volume uniformity of the spots produced. Further improvement of the contact control is achieved by using an actuator, for example a piezoelectric or thermomechanical actuator, integrated into the microstructure. In addition, in the case of a row of levers, the integrated actuators allow the contact of each device with the surface to be individually controlled.

The integrated piezoresistors allow servocontrol of the robot and said actuators.

Displacement along each axis is provided by a stepper motor. Each motor, supplied with AC current, is associated with a linear position sensor, allowing closed-loop position control.

The angle of incidence, that is to say the angle of contact between the lever and the surface on which the deposition is carried out, has an appreciable influence on the size of the drops deposited. The most satisfactory results are obtained with an angle close to 60°. It should be noted that, during the contacting phase, this angle varies from 60° to 45° when lowering the lever after contact by 50 microns (i.e. the value of the distance through which the lever is lowered after contact, which hereafter will be termed the "depth of contact"). Thus, the volume of liquid deposited is varied by applying a higher or lower bearing force.

The angle can be varied by means of a movable part fixed to the Z axis and rotating with respect to the Y axis. It is possible to control this angle directly by means of microcontrollers connected to the drive system.

The deposition step may be carried out in the following manner, as illustrated by FIGS. 9A-9D.

The first step (FIG. 9A) consists in filling the channel and the reservoir (when it exists) machined along the axis of the levers. To do this, the control software allows the levers to be positioned above the reservoir containing the liquid to be deposited and immerses them in this liquid. An electric field is then created by applying a voltage between the machined electrodes on the levers and the liquid. Next, the levers are moved out of the liquid, and the robot positions them above the location of the first spot to be deposited.

Figure 9A:
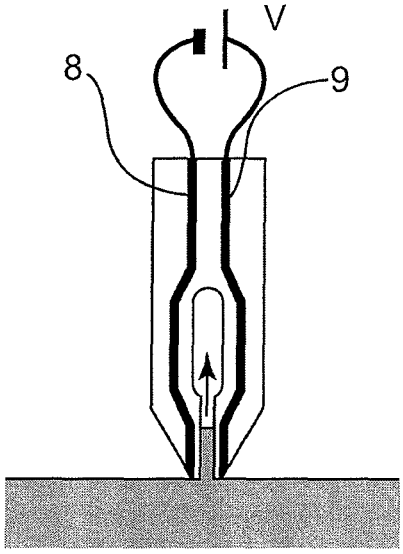
FIGS. 9A-9D illustrate the various methods of picking up a liquid and depositing it.
Figure 9B:
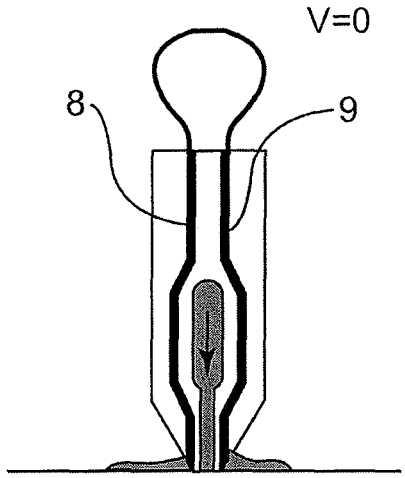
Figure 9C:
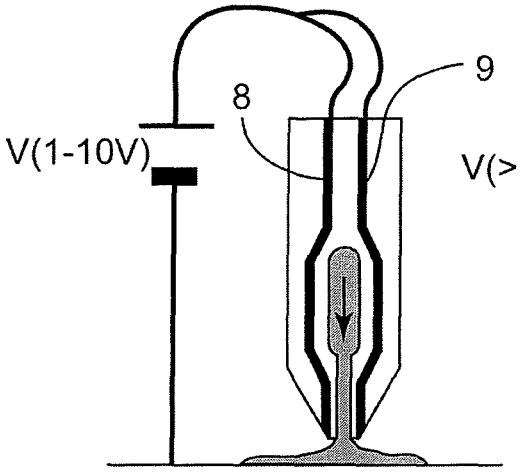
Figure 9D:
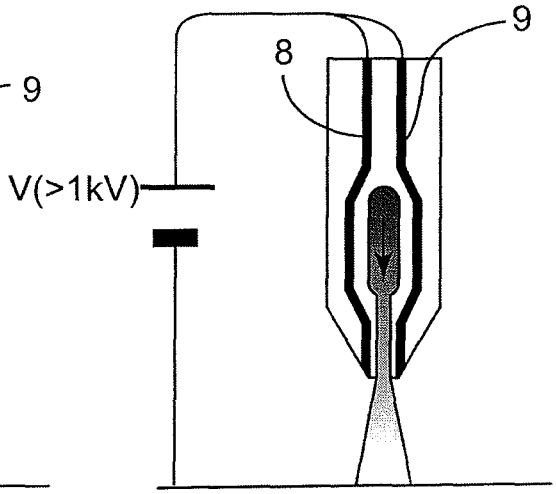

We therefore have two options: either the robot moves the levers against the surface and the deposition takes place by contact (FIG. 9B); or the robot positions the levers above the surface (a few microns away) so that this time there is contactless deposition (FIGS. 9C and 9D).

In the case of contact deposition, the volume deposited depends on the depth, the contact angle and the contact time. The field effect may also be used to control the volume of the deposit—reducing the electric field between the conducting tracks increases the amount of liquid deposited, and vice versa. If a row of levers is used, deposition by each lever is individually controlled thanks to the integrated actuators, which act on the characteristics of the contact, and the electrodes.

In the case of contactless deposition, a potential difference of a few volts up to 10 V is applied between the metal tracks and the deposition surface, which has to be conducting or to have a conductive coating. Thus, the resulting field effect (dielectrophoresis) sucks up the liquid. A higher potential difference (above 1 kV) may result in an electrospray.

This procedure is repeated for each set of spots to be deposited, according to a program set up by the user, until the number of spots that can be produced without refilling have been reached. If this situation occurs, the robot interrupts the deposition task and resumes that of picking up liquid.

The invention claimed is:

1. A process for fabricating a device for depositing biological solutions including at least one flat silicon lever having a central body and an end region that forms a tip in which a slit or groove is provided, comprising:

a) at least one step of depositing silicon oxide on a front face of a silicon-on-insulator substrate having a buried insulating layer;

b) producing, for each lever, at least one metal track;

c) at least one chemical or ion etching step carried out via the front face of the silicon substrate in order to define the outline of the levers, and at least one slit or groove, the outline of the levers being defined by chemical or ion etching down to the buried insulating layer; and d) a chemical or ion etching step carried out via the rear face of the substrate in order to remove it, including the buried insulating layer, and to free at least one lever.

2. The process as claimed in claim 1, wherein step b) also includes:

b1) a second step of depositing oxide on the front face in order to isolate at least one metal track.

3. The process as claimed claim 1, wherein said step c) comprises chemical or ion etching down to the buried insulating layer in order to define, in addition to the outline of the levers, a slit and/or an emergent opening constituting a reservoir for at least one lever.

4. The process as claimed in claim 1, wherein said step c) comprises first chemical or ion etching of the substrate, this operation being stopped before the buried insulating layer in order to define at least one groove and/or a non-emergent cavity forming a reservoir, for at least one lever, and second chemical or ion etching of the substrate down to the buried insulating layer in order to define at least the outline of the levers.

5. The process as claimed in claim 4, wherein during the first chemical or ion etching, the outline of the levers is defined over part of their thickness.

6. The process as claimed in claim 1, wherein before a), a step of implanting at least one piezoresistor is provided.

7. The process as claimed in claim 1, further comprising a step of depositing an integrated actuator.

8. The process as claimed in claim 7, wherein said step of depositing an integrated actuator comprises the deposition of a piezoelectric film of $PbZrO_3/PbTiO_3$ by sputtering.

9. The process as claimed in claim 8, wherein said piezoelectric film is isolated from a biological solution by a layer of a material chosen from the following: silicon oxide, PTFE, or a polymer other than PTFE.

10. The process as claimed in claim 7, wherein said step of depositing an integrated actuator comprises the low-pressure chemical vapor deposition (LPCVD) of an $Si_3N_4$ layer followed by deposition of a Cr layer and of an Au layer in order to produce a heating resistor, thus forming a bimetallic strip.

* * * * *